US008327510B2

(12) United States Patent
Schlesinger

(10) Patent No.: US 8,327,510 B2
(45) Date of Patent: Dec. 11, 2012

(54) TEMPORARY PANTS HEMMING DEVICE

(76) Inventor: Danielle Schlesinger, Chicago, IL (US)

( * ) Notice: Subject to any disclaimer, the term of this patent is extended or adjusted under 35 U.S.C. 154(b) by 808 days.

(21) Appl. No.: 12/384,325

(22) Filed: Apr. 2, 2009

(65) Prior Publication Data

US 2010/0251459 A1 Oct. 7, 2010

(51) Int. Cl.
*A41D 27/24* (2006.01)

(52) U.S. Cl. ..... 24/459; 2/269

(58) Field of Classification Search ..... 24/92, 113 R, 24/114.4, 114.9, 114.12, 459, 462, 107; 2/232, 2/269, 274
See application file for complete search history.

(56) References Cited

U.S. PATENT DOCUMENTS 592,610 A * 10/1897 Hornich, Jr. ..... 40/1.5
1,452,052 A * 4/1923 Nalle ..... 24/114.4
4,308,647 A 1/1982 Gillis
4,793,155 A * 12/1988 Law ..... 63/40
5,511,289 A * 4/1996 Melia ..... 24/66.9
5,557,830 A 9/1996 Davis
5,655,271 A * 8/1997 Maxwell-Trumble et al. . 24/459
5,787,511 A * 8/1998 Garside ..... 2/269
6,199,247 B1 * 3/2001 Tsai ..... 24/343
6,295,703 B1 * 10/2001 Adams et al. ..... 24/459
6,718,600 B1 4/2004 Gillis
2010/0038838 A1 * 2/2010 Gallo ..... 269/254 CS

* cited by examiner

*Primary Examiner* — James Brittain
(74) *Attorney, Agent, or Firm* — Olson & Cepuritis, Ltd.

(57) ABSTRACT

A device and method for temporary hemming/cuffing children's pants legs is disclosed. A base member and a securement member sandwich material to be hemmed between one another. The base member and the securement member are operatively engaged with one another by way of tab extending axially from the securement member, which are engageable with lip portions of the base member. When the securement member and the base member sandwich the material to be hemmed, portions of the material, especially any seams, are positioned within spaces or passages defined by the tabs.

14 Claims, 3 Drawing Sheets

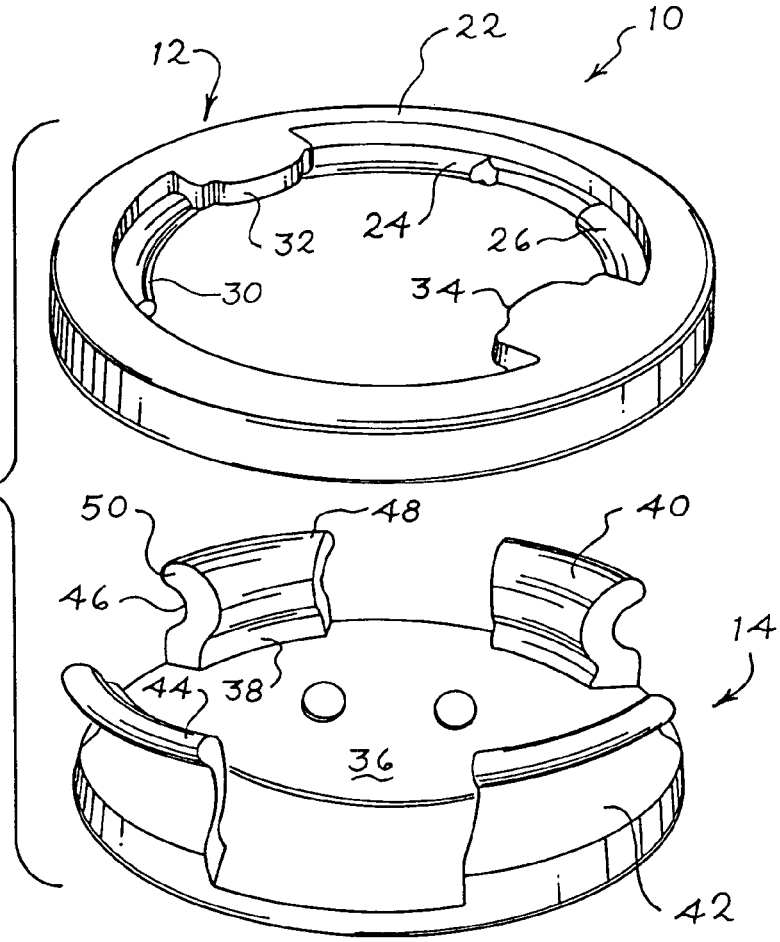
Fig. 2
Fig. 3
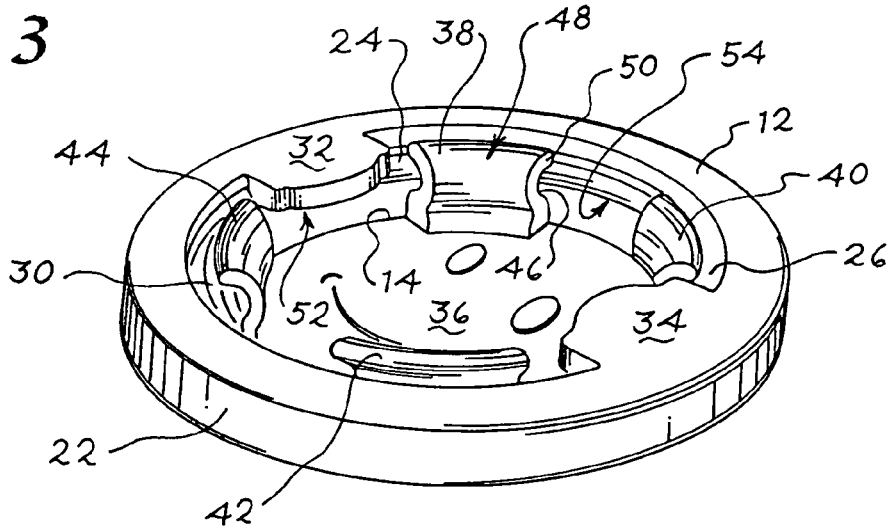

Fig. 4
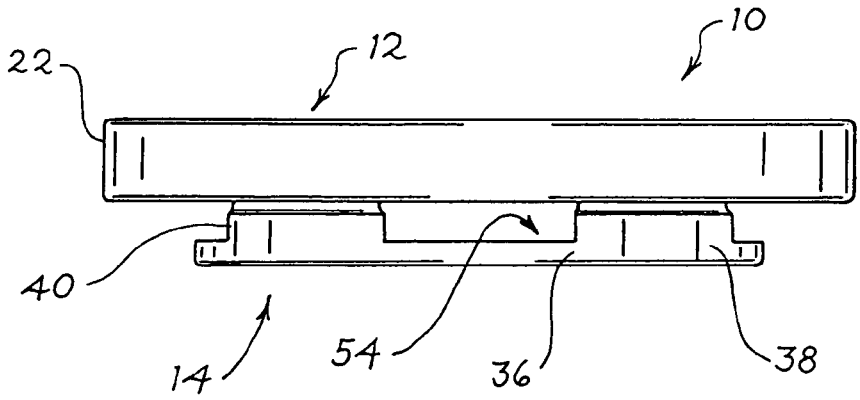
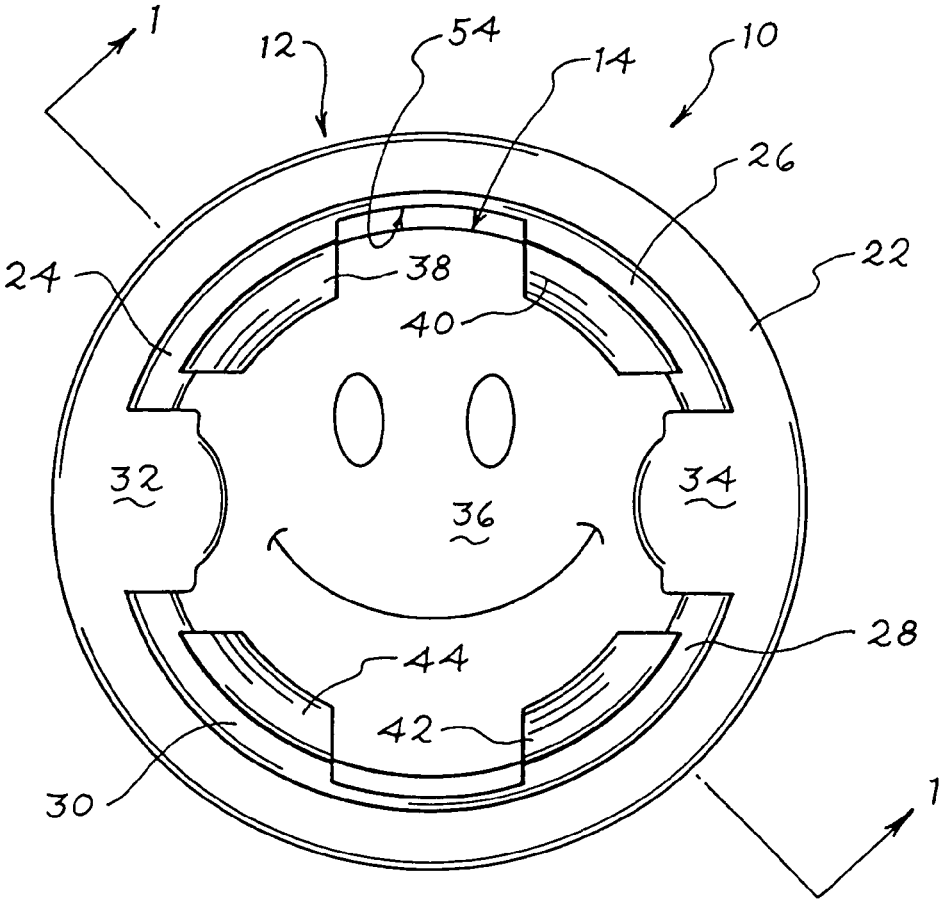
Fig. 5

TEMPORARY PANTS HEMMING DEVICE

FIELD OF THE INVENTION

The present invention relates generally to the field of making a hem or cuff, and more particularly to hemming devices, temporary hems, and methods for making temporary hems.

BACKGROUND OF THE INVENTION

In the clothing art, there is often a need to adjust the length of a garment. A typical way that the length of a garment has been adjusted is through the use of a hem or cuff. A hem in the clothing art has been formed by folding under or over the edge of a garment and then sewing down the edge to thereby shorten the garment.

However, there is a major drawback in the aforementioned hemming technique, in that it takes a relatively significant amount of time and effort to make the hem, such that is not suitable if one desires to make a temporary hem. This is particularly true in the case of garments for children, specifically pants for toddlers. Since children grow at a relatively fast rate, parents typically tend to buy larger size pants for the children to grow into. The pants legs are initially too long and require hemming to prevent the children from tripping over the ends of the pants and possibly injuring themselves.

Making a hem also generally requires the use of a sewing machine, which many households do not possess. One could hire a tailor to hem pants legs, but the cost of doing so is cost prohibitive for a relatively cheap garment that would only be worn for a limited time by a toddler. This cost is increased because the stitching holding the cuff must be moved in order to readjust the length of the pants once the toddler has outgrown the hemmed pants.

One way of temporarily satisfying this need for a hem is to use pins to form a temporary hem. However, use of pins on garments worn by toddlers is not safe and is to be avoided.

Another way of temporarily satisfying this need is to use clips known in the art, such as paper clips, to form a temporary hem. The use of such clips is not effective, however. Most such clips are designed to secure materials with generally thin, flat surfaces. The clips known in the art are not adapted to clip thick material with uneven surfaces such as seamed fabrics. When thick material such as a pant leg is placed between the arms of a conventional clip, the clip generally becomes deformed into a V-shape and fails to exert sufficient force to secure a pant cuff.

One device that addresses some of the aforementioned concerns is U.S. patent application Ser. No. 12/287,939, which was filed on Oct. 15, 2008 and entitled "Temporary Pants Hemming/Cuffing Devices." U.S. patent application Ser. No. 12/287,939 is hereby incorporated by reference into the present application in its entirety.

Accordingly, it is a general object of the present invention to provide an improved temporary hem that is easily adjustable, a method for making such a hem, and a device useful for making such a hem.

Another object of the present invention is to provide a hemming device which can be slipped over the folded-over hem, and can accommodate the side-seam located in most pants legs.

A further object of the present invention is to provide uniquely configured and aesthetically pleasing ornamental designs to be included with each hemming device.

A still further object of the present invention is to provide hemming devices which are safe to be used on toddler's garments.

SUMMARY OF THE INVENTION

The present invention is directed to hemming or cuffing devices which are safe to be used on children's garments. The term "hemming" referenced herein encompasses cuffing or other processes in which the length of a fabric is adjusted. Multiple embodiments of devices are disclosed for temporarily hemming children's pants legs.

A hemming device according to the present invention includes a base member and a securement member. The base member and the securement member are detachably engageable with one another and form the overall hemming device.

The base member may include a rim portion that is preferably of a generally circular shape. At least one, and preferably, a plurality of lip members extend or project radially inward from the rim portion. In a preferred embodiment, the lip members are integrally formed or unitary with the rim portion. The lip members are spaced from one another. The rim portion may also include one or more detents that extend radially inward from the rim portion.

The securement member comprises a central portion, which is preferably substantially planar. A plurality of tab members extend or project from the central portion. In a preferred embodiment, the tab members are integrally formed or unitary with the central portion. These tab members extend laterally from the central portion. The tabs define recessed portions that are adapted to operatively engage the lip members of the base member when the base member is engaged with the securement member.

The device of this preferred embodiment can be clipped to material, such as a pant leg, to form a temporary hem. The device is particularly adapted to be placed upon the outside seam portion of a pant leg. Grip surfaces such as rubber can be added to the device to increase the frictional resistance between the device and fabric material.

The method for hemming the fabric material using the present invention involves folding the material to be hemmed. The fabric material is then sandwiched between the base member and the securement member. Although functionally it does not matter which of the base member or the securement member are placed on the outside of the material, in a preferred embodiment, the central portion of the base member can include embellishments or decorative elements, and should therefore be placed on the viewable portion of the material. Thicker portions of the material, such as the seam of a pant leg, are positioned to pass through passages defined by the rim portion of the base member and the central portion of the securement member. The base member and the securement member are then pushed together by the user such that the tab members operatively engage the lip members with the materials secured therebetween. In a preferred method of hemming, one side of the base member and the securement members are urged together and then the opposing side is urged or rolled together. The tab members, and preferably the entire securement member, are made of a resilient material that enables the tab member to be biased to returning to its initial position and exert a compressive force on the material sandwiched between the securement member and base member. The resiliently deformable nature of the fabric itself also assists in securing the device.

These and other features and advantages of the present invention will be understood upon consideration of the following detailed description of the invention and the accompanying drawings.

BRIEF DESCRIPTION OF THE DRAWINGS

FIG. 2 is a perspective view of the preferred embodiment of the present invention with the base member and securement member disengaged from one another;

FIG. 3 is a perspective view of the preferred embodiment of the present invention with the base member and securement member engaged with one another (without material sandwiched therebetween);

FIG. 4 is a side elevated view of the present invention with the base member and securement member engaged with one another (without material sandwiched therebetween); and FIG. 5 is a top plan view of the present invention with the base member and securement member engaged with one another (without material sandwiched therebetween).

DESCRIPTION OF THE PREFERRED EMBODIMENTS

Figure 1:
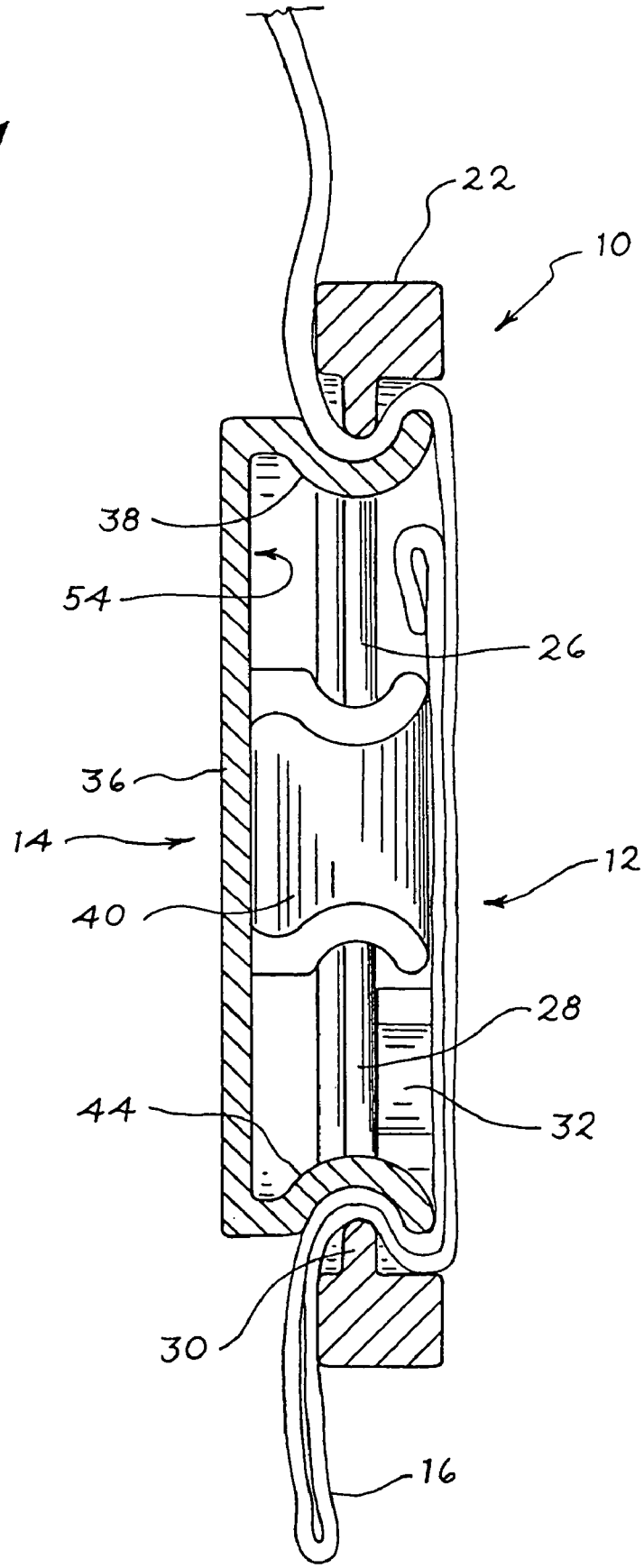
FIG. 1 is a cross sectional view of a hemming device according to a preferred embodiment of the present invention applied to a pant leg.

The present invention is directed to temporary hemming of fabric material, and more particularly directed to the temporary hemming or cuffing children's garments and specifically children's pants in a quick, safe and aesthetically appealing manner. The invention disclosed herein is, of course, susceptible of being embodied or conducted in many different manners. Shown in the drawings and described hereinbelow in detail is a preferred embodiment of the invention. It is to be understood, however, that the present disclosure is an exemplification of the principles of the invention and does not limit the invention to the illustrated embodiment.

Referring to FIG. 1, in accordance with a preferred embodiment of the present invention, a perspective view of a hemming device 10 is shown as applied to a pant leg. Preferably the device 10 is constructed of resiliently deformable plastic material, and more preferably thermoplastic material. The hemming device 10 can also be constructed of other suitable materials known in the art, such as metal or wood.

A base member 12 and a securement member 14 are provided. When the base member 12 and the securement member 14 are operatively engaged with one another, while also sandwiching a fabric material 16 therebetween, the temporary hem is formed.

A primary benefit of the present invention is the ability to accommodate materials to be hemmed that includes portions that are of different effective thicknesses. For example, as shown in FIG. 1, a pant leg is typically comprised of material 16 sewn in a manner that forms a seam. This seam, because it includes two portions of the material 16, is thicker than the other portions of the pant leg. This thicker portion is made even thicker when folded as part of hemming. Another benefit of the present invention is that a temporary hem may be formed without the need to puncture or otherwise damage material. The elimination of pins or other such typical hemming devices also provides a safer alternative for the hemming of children's clothing.

Referring to FIGS. 2-4, a preferred embodiment of the base member 12 and the securement member 14 is provided. The base member defines a rim portion 22, which is of a substantially circular shape. Extending radially inward from the rim portion 22 is a plurality of lip members 24, 26, 28 and 30. The lip members 24, 26, 28 and 30 define arcuate paths along the interior of the rim portion 22. Detents 32 and 34 are also formed with the rim portion 22 and extend radially inwardly. Detents 32 and 24 are preferably positioned parallel to and slightly offset from the lip members 24, 26, 28 and 30.

The securement member 14 includes a central portion 36. This central portion is preferably substantially circular in shape. The central portion 36 may include an embellishment or other ornamental feature for decorative purposes. Unitary with the central portion 36 are a plurality of tab members 38, 40, 42, and 44. For example, tab 38 extends laterally from the outer edge of the central portion 36. Tab 38 extends in a substantially perpendicular relationship to the central portion 36. Tab 38 also defines a recessed or curved portion 46 into which a lip member of the base member 12, such as lip member 24 may be seated when the securement member 14 and the base member 12 are engaged with one another. The recessed portion 46 is of sufficient size to accommodate a section of material to be held between the tab members and lip members. The distal end 48 of tab 38 defines a catch portion 50. The distal end 48 of tab 38 is preferably of a width that is similar to that of lip member 24 of the base member 12. Each of the tab members 38, 40, 42, and 44 are of similar shape and size, and are spaced about the periphery of the central portion. Although it is not shown, the tab members may include more than one recessed portion and catch portion to accommodate materials of different thicknesses. The detent members 32 and 34 limit the possible rotation of the securement member 14 with respect to the base member 12.

In a highly preferred embodiment, the recessed portions of the tab members may be of different depths. For example, referring again to FIG. 1, the hemming device 10 is secured to the pant leg such that two of the tabs engage a double layer of material, whereas the other two tabs engage a single layer of material. In this situation, the recesses for the tabs that engage the double layer of material are larger than the recesses for the tabs that engage the single layer of material.

Referring to FIGS. 3-5, when the base member 12 and the securement member 14 are engaged with one another, a plurality of spaces or through passages, such as passages 52 and 54 are formed. Although not shown, the rim portion may also include cut-out portions corresponding to the through passages to provide additional space of seams. As discussed, above, thicker portions of material, such as seams, are positioned within these passages. The tab members 38, 40, 42, and 44 engage the lip members 24, 26, 28 and 30. For example, as the securement member 14 and the base member 12 are urged towards each other into operative engagement, tab member 38 bends inward to allow the distal end portion 48 to pass over the lip member 24, and then springs back to its initial position thereby seating the lip member 24 within the recessed portion 46. Catch portion 50 is configured to prevent unintentional disengagement of the tab member 38 from the lip member 24. As discussed, it should be understood that the engagement of the securement member 14 and the base member 12 includes material sandwiched therebetween as shown in FIG. 1, but is depicted in FIGS. 2-4 without the material for ease of reference. In use, each tab member exerts a force on the material sandwiched between itself and its respective lip member because of its tendency to spring back to its initial position.

The present invention is discussed in the context of pants legs, but of course, can also be used with any other material or fabric. Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A hemming device comprising:

a base member and a securement member detachably engageable with the base member with a material being hemmed held therebetween;

the base member including a rim portion defining a circumference, a plurality of lip members extending radially inwardly from the rim portion, the base member further including at least one axial detent projection extending from the rim portion and terminating within the rim portion circumference;

the securement member comprising a central portion, the central portion being substantially planar, the securement member further comprising a plurality of tab members positioned about a periphery of the central portion and extending laterally from the central portion, each of the plurality of tabs defining recessed portions and adapted to operatively engage at least one of the plurality of lip members of the base member; and wherein when the base member is engaged with the securement member, the rim portion of the base member and the central portion of the securement member define a plurality of through passages of sufficient size to allow passage of at least a portion of the material being hemmed and other portions of the material being hemmed are sandwiched by the plurality of tabs and plurality of lip members.

2. The hemming device of claim 1, wherein the base member defines a substantially circular circumference, and the central portion of the securement member defines a substantially circular circumference.

3. The hemming device of claim 1, wherein the plurality of tabs define a plurality of recessed portions adapted to engage the lip members.

4. The hemming device of claim 1, wherein at least one detent of the base member limits the rotational movement of the base member relative to the securement member.

5. The hemming device of claim 1, wherein the plurality of tab members consists of a first pair and a second pair of tab members, the first pair of tab members defining recesses of a greater depth than the recesses defined by the second pair of tab members.

6. A device suitable for hemming clothing, the device comprising:

a base member and a securement member, the base member and the securement member cooperatively engageable with one another with a material being hemmed held therebetween;

the base member defining a substantially circular rim portion, the base member further including at least one lip member extending radially inward from an arcuate portion of the rim portion;

the securement member comprising a substantially circular central portion;

the securement member further including a plurality of tab members extending from the central portion, at least one of the tabs adapted to operatively engage the at least one lip member when the base member is engaged with the securement member such that at least a portion of the material being hemmed is sandwiched by the at least one tab and the at least one lip member; and a plurality of through passages defined by the base member and the securement member when the base member is engaged with the securement member, the through passages being of sufficient size to allow passage of at least a portion of the material being hemmed.

7. The hemming device of claim 6, wherein the at least one tab defines at least one recessed portion adapted to engage the lip member.

8. The hemming device of claim 6, wherein at least one detent is provided on the rim portion, and the detent limits the rotational movement of the base member relative to the securement member when the base member is engaged with the securement member.

9. The hemming device of claim 6, wherein the plurality of tab members consists of a first pair and a second pair of tab members, the first pair of tab members defining recesses of a greater depth than the recesses defined by the second pair of tab members.

10. A method of hemming clothing, wherein the method comprises the steps of:

folding a portion of clothing material;

sandwiching the folded material between a base member and a securement member, wherein the base member includes a rim portion and a plurality of interspaced lip members extending radially inwardly from the rim portion, and wherein the securement member includes a substantially planar central portion and a plurality of tab members extending laterally from and positioned about a periphery of the central portion;

positioning a thicker portion of material through at least one through passage defined by the rim portion of the base member and the central portion of the securement member; and urging the base member toward the securement member such that the tab members operatively engage the lip members with the materials secured therebetween.

11. The method of claim 10, wherein the base member defines a substantially circular circumference, and the central portion of the securement member defines a substantially circular circumference.

12. The method of claim 10, wherein the plurality of tabs define a plurality of recessed portions adapted to engage the lip members.

13. The method of claim 10, wherein the plurality of tab members consists of a first pair and a second pair of tab members, the first pair of tab members defining recesses of a greater depth than the recesses defined by the second pair of tab members.

14. The method of claim 10, wherein at least one detent limits the rotational movement of the base member relative to the securement member.

* * * * *